US006126878A

United States Patent [19]

Misselbrook

[11] Patent Number: 6,126,878

[45] Date of Patent: Oct. 3, 2000

[54] APPARATUS AND METHOD FOR PRODUCING AN EXTRUDATE

[75] Inventor: John Misselbrook, Southampton, United Kingdom

[73] Assignee: Collag Limited, Hampshire, United Kingdom

[21] Appl. No.: 08/894,743

[22] PCT Filed: Feb. 13, 1996

[86] PCT No.: PCT/GB96/00339

§ 371 Date: Jan. 30, 1998

§ 102(e) Date: Jan. 30, 1998

[87] PCT Pub. No.: WO96/26828

PCT Pub. Date: Sep. 6, 1996

[30] Foreign Application Priority Data

Feb. 28, 1995 [GB] United Kingdom ..... 9503961

[51] Int. Cl.[7] ..... B02C 31/00

[52] U.S. Cl. ..... 264/141; 264/142; 264/143; 264/176.1; 264/211.1; 425/206; 425/313; 425/382 R

[58] Field of Search ..... 264/141, 211.1, 264/142, 143, 176.1; 425/308, 311, 313, 382 R, 206

[56] References Cited

U.S. PATENT DOCUMENTS

| | | | |
|---|---|---|---|
| 3,332,111 | 7/1967 | Hafliger | 425/311 |
| 4,599,015 | 7/1986 | Krambrock | 406/66 |
| 4,767,217 | 8/1988 | Van Den Brink et al. | 366/168 |
| 5,443,764 | 8/1995 | Lloyd et al. | 264/15 |

FOREIGN PATENT DOCUMENTS

| | | |
|---|---|---|
| 0 163 619 | 4/1985 | European Pat. Off. . |
| 2 008 612 | 11/1978 | United Kingdom . |
| 1 561 500 | 2/1980 | United Kingdom . |

*Primary Examiner*—Jan H. Silbaugh
*Assistant Examiner*—Stephan Staicovici
*Attorney, Agent, or Firm*—Renner, Otto, Boisselle & Sklar P.L.L.

[57] ABSTRACT

An apparatus for producing an extrudate (e.g., water-dispersable extruded rod-shaped granules) from an extrudable powder-based material (e.g., a finely-divided water-insoluble powder) includes a hopper for the extrudable material having at least one extrusion aperture at its lower end, a rotatable extruder tool at or near the lower end of a first drive shaft for forcing the extrudable material through the aperture(s) and a rotatable feeder at or near a lower end of a second drive shaft for feeding the extrudable material to the extruder tool. The first drive shaft is rotatably mounted within the second drive shaft by axially displaced bearings, the second drive shaft being mounted within a fixed bearing housing by further axially displaced bearings. Drive motors are connected by respective drive trains to the upper ends of the first and second drive shafts, respectively.

15 Claims, 2 Drawing Sheets

APPARATUS AND METHOD FOR PRODUCING AN EXTRUDATE

Figure 1:
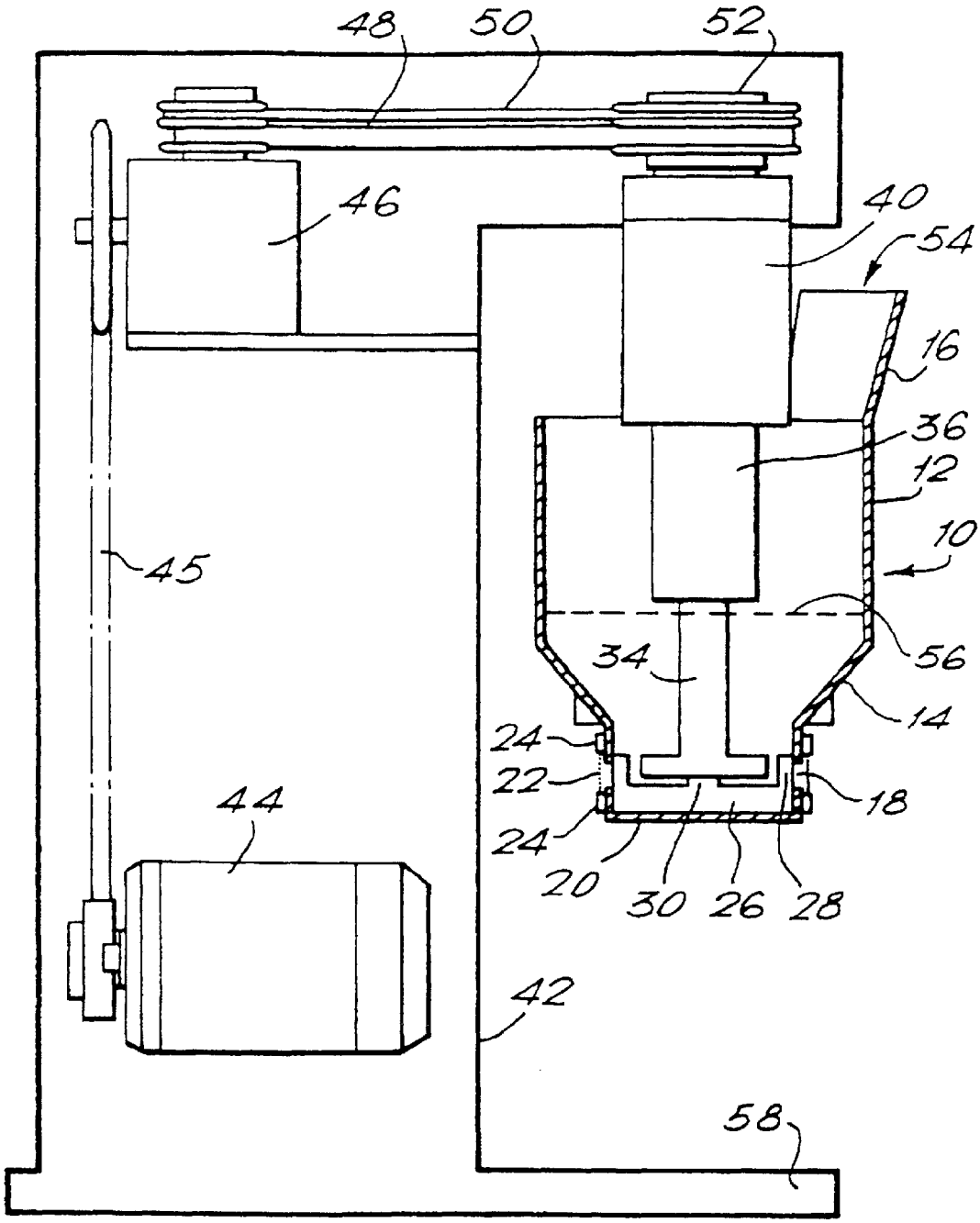

The invention relates to an apparatus and a method for producing an extrudate.

The production of water-dispersable extrudates, for example in the form of extruded granules, from finely divided water insoluble powders is known. One application for such extrudates is as a delivery system for chemical substances used in agriculture. An object of such extrudates is to provide a delivery system for finely-divided water-insoluble powder which avoids the need for users to handle the materials concerned in powder form. The extrudates are more convenient to handle than the powder and reduce potential health hazards resulting from the handling of such finely divided powders. The production of extrudates by utilizing pressure or shear to force moist powder through apertures is well known.

A basket-type extruder for the extrusion of plastic or pulverant materials for obtaining an extrudate in the form of rod-shaped bodies is described in European patent application EP-A-0 163 619. Embodiments are described with a hopper having, at its lower end, an annularly extending opening with a perforated screen. The source material is inserted into the hopper and is then pressed through the perforated screen in order to produce the extruded rod-shaped bodies. A rotating extruder tool for forcing the powder through the screen and a feeding mechanism for feeding the powder to the extruder tool are provided. The extruder tool consists of a disc with extruder blades disposed around its periphery. The extruder tool is driven by means of a drive shaft from a motor located below the hopper, the drive shaft being mounted in bearings in a lower portion of the housing of the hopper. The feeder mechanism is driven via a second drive shaft from a second motor located above the hopper.

Such equipment can be used to produce extrudates of insoluble, finely-divided powders which can disperse relatively readily and rapidly in water. However, the initial performance of such equipment with materials of this type cannot be maintained. Long-term operation of such equipment with such finely-divided water-insoluble powders leads to reductions in performance. Experience shows that with such equipment and the products of the type described, a gradual increase in temperature is experienced. This increase in temperature is accompanied by a decrease in the efficiency and production rate of the machine and a degradation in the properties of the extrudate when dried. Long-tern operation of the apparatus on a continuous basis has proved impossible due to the temperature increase, which leads to a gradual reduction in the production rate and frequent stoppages due to equipment malfunctions.

By inspection it has been found that the pastes which form as the moist finely-divided water-insoluble powders are forced though the perforated screen of conventional low-pressure extruders, typified by the patent application referenced above to effect the extrusion are very invasive. When subjected to the pressures required to force these pastes through an aperture the pastes find their way into and wear seals fitted to protect the bearings for supporting the extruder tool and eventually damage the bearings themselves.

It has been proposed to modify the seal designs to eliminate bearing damage. However, no seal design has yet proved successful in preventing the ingress of the paste into the bearing housings. The provision of pressure release slots around the screen for the reduction of pressure on the seals has also been employed. However, these measures have little effect on preventing the damage caused by the pastes formed from the finely-divided water-insoluble powders. As a result of this, it does not appear possible by means of simple modifications or improvements to the prior art design of extruder typified by European patent application EP-A-0 163 619, to provide a machine capable of producing in a reliable and economic manner extrudates from finely-divided water-insoluble powders.

Patent Specification DE-C-807 187 discloses extrusion apparatus with a hopper with an extrusion aperture at its lower end and a rotatable extruder tool and a rotatable feeder each mounted on the lower end of a respective shaft within the hopper, the shafts each having a single bearing above the feeder and, clearly, a second bearing below the feeder.

In accordance with a first aspect of the invention, there is provided apparatus for producing an extrudate from an extrudable material, the apparatus comprising a hopper for the extrudable material having at least one extrusion aperture at or near its lower end; a rotatable extruder tool at or near the lower end of a first drive shaft for forcing the extrudable material though the aperture(s); a rotatable feeder at or near a lower end of a second drive shaft for feeding the extrudable material to the extruder tool; and bearings located above the extruder tool, for rotatably mounting the first drive shaft and the second drive shaft;

characterised in that said bearings comprise first and second bearings mounting the first drive shaft and axially spaced from one another and third and fourth bearings mounting the second drive shaft and axially spaced from one another.

Thus the drive mechanism and the bearings for the drive shafts are located above the invasive paste which forms during the extrusion process thereby avoiding problems associated with the effect of the paste on bearing seals and the bearings.

By removing the need for bottom bearings a potential source of heat is removed, with the result that the temperature of the extrudable material in the hopper can be kept lower, this leading to a better and more uniform extrudate product quality. With the removal of the potential source of heat which can have a limiting effect on the production rate, a higher output can be achieved. Also avoiding stoppage times for maintenance and repair tasks caused by bottom bearing wear leads to a further increase in obtainable manufacturing output.

A further advantage which results from the invention is that the collection of the extruded material is simplified, as the drive motor for the extruder tool no longer needs to be located below the extrusion aperture(s).

More preferably, the bearings are located above a maximum filling level for the extrudable material within the hopper. However, it should be noted that the extrudable material above the region of the feeder and the extruder tool blades will not be at high pressure and is therefore not invasive in the manner of the resulting paste in that region. This means that it is possible to provide effective seals for the bearings so that the level of the extrudable material in the hopper is not critical.

Preferably, one of said first and second drive shafts (e.g., the second drive shaft) is disposed substantially coaxially around the other of said first and second drive shafts (e.g., the first drive shaft). This facilitates a concentric arrangement of the feeder and extruder tool. The second drive shaft is preferably in tubular form for strength. The first drive shaft is preferably solid for strength reasons, but could also be tubular.

In the preferred embodiment a first drive train is provided for driving said first drive shaft from overhead and a second drive train is provided for driving said second drive shaft from overhead. The first drive train includes a first gearing mechanism and the second drive train includes a second gearing mechanism. Also, a first independently controllable motor is provided for the first drive train and a second independently controllable motor is provided for the second drive train.

In the preferred embodiment said at least one aperture comprises an annularly extending opening and a perforated screen located over that opening. The extruder tool comprises a substantially disc-shaped portion and, disposed around the periphery of the disc, a plurality of axially extending extruder tool blades.

The invention also includes the use of apparatus as defined above for producing an extrudate (e.g., water-dispersable extruded rod-shaped granules) from an extrudable material (e.g., finely-divided water-insoluble powder).

In accordance with another aspect of the invention, there is provided a method of producing an extrudate (e.g., a water-dispersable extrudate) from an extrudable material (e.g., a moist finely-divided water-insoluble powder) comprising the steps of:

introducing into the hopper of an apparatus as defined above the extrudable material; and forcing the extrudable material through said at least one aperture to form the extrudate.

Figure 2:
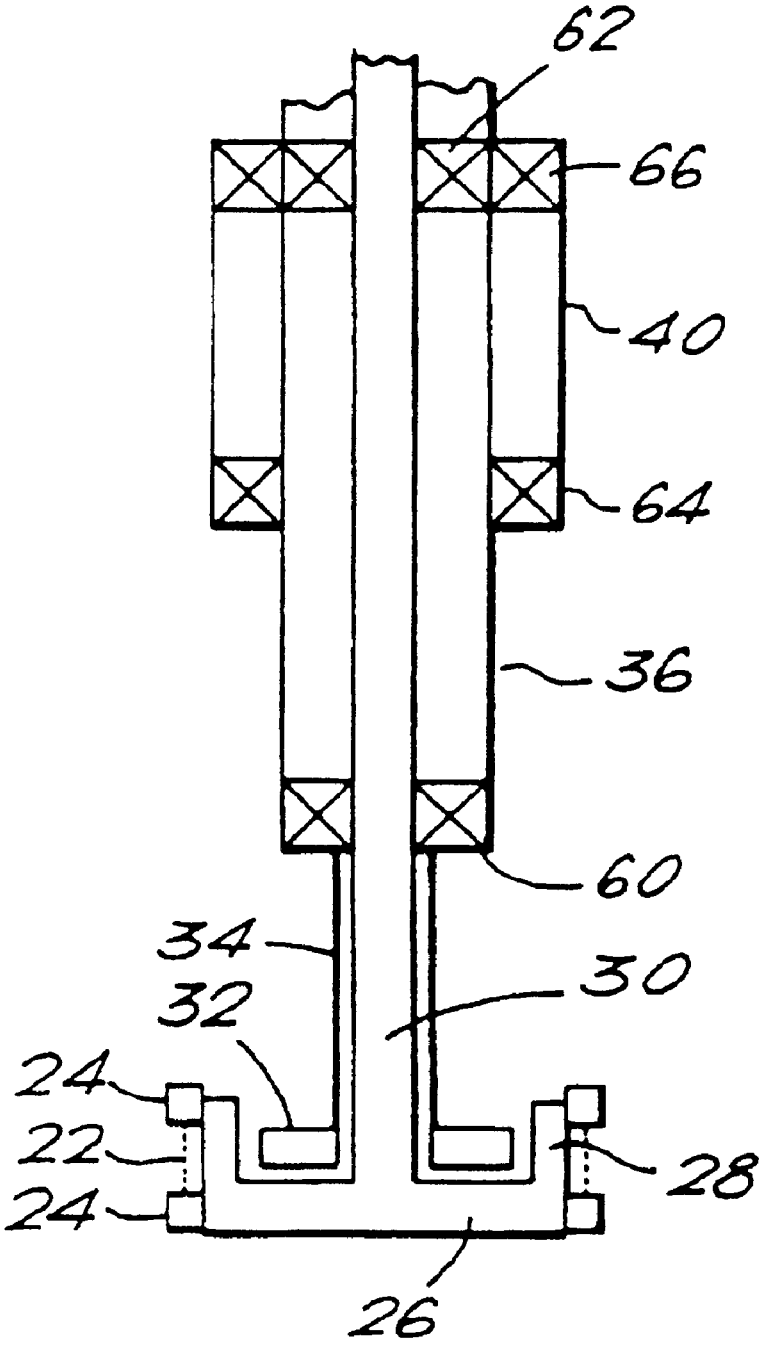

An embodiment of the invention will be described hereinafter, by way of example only, with respect to the accompanying drawings in which:

FIG. 1 is a schematic side view, partly in cross-section, of an embodiment of an extrusion apparatus in accordance with the invention; and FIG. 2 is a schematic view, in cross-section, of a shaft arrangement of the apparatus of FIG. 1

The apparatus includes a hopper generally designated at 10 including a main hopper housing 12 with a funnel shaped portion 14 leading to a lower basket portion having an extrusion opening 18 which extends at least partially annularly around the lower part of the hopper. The hopper can be made of any suitable material, for example stainless steel. A chute 16 is provided for the insertion of the powder to be extruded. A bottom 20 to the hopper housing can optionally be provided. This can be solid, or in the form of a number of strengthening ribs extending across the bottom of the housing, or could be omitted completely. Where a bottom 20 is provided, this can be connected to the main portion of the hopper by one or more struts (not shown) extending across the annularly extending extrusion opening 18.

A perforated screen 22 having a plurality of apertures sized in accordance with the extrudate to be produced extends around the lower portion of the hopper and across the extrusion opening 18. The perforated screen 22, which can be made of stainless steel, for example, is removably attached to the hopper by clamps or clamping bands 24. The apertures in the screen 22 can have any suitable size, shape and distribution according to the extrudate to be formed.

Within the hopper arrangement there is provided an extruder tool 26 comprising a disc shape member with extruder tool blades 28 at the periphery thereof. The extruder tool 26 is connected to or is integral with a vertically extending drive shaft 30, which can be tubular or solid. A feeder arrangement 32 is also provided for feeding the powder to be extruded to the extruder tool blades 28 of the extruder tool 26. The feeder 32 is driven by means of a tubular drive shaft 34 which extends coaxially with and around the drive shaft 30 of the extruder tool 26. The extruder tool 26 and the feeder 32 can be made of stainless steel or another suitable material.

The feeder drive shaft 34 is connected to a bearing arrangement 36 for rotatably mounting the extruder tool drive shaft 30 within the feeder drive shaft 34. A further bearing arrangement 40 is provided for rotatably mounting the feeder drive shaft 34 within the hopper 10 and with respect to a housing 42 of the apparatus. In this embodiment the feeder drive shaft 34 and the extruder tool drive shaft 30 are each driven by respective motors, only one of which 44 is shown (the other being located behind the motor 44 as shown in FIG. 1). The drive from the two motors 44 is supplied via respective drive belts 45 to respective gear boxes 46. Only one drive belt 45 and gear box 46 is shown in FIG. 1 (the other drive belt and gear box being located respectively behind the drive belt 45 and gear box 46 shown in FIG. 1). From the respective gear boxes 46, further drive belts 48 and 50 extend to drive arrangements 52 (once again shown one behind the other) above the bearing arrangement 40. A first, high torque drive belt 48 is connected to a drive pulley 52 directly in line with the extruder tool drive shaft 30 to drive that drive shaft 30. A second drive pulley located behind the drive pulley 52 is connected via a further gearing or belt drive mechanism to the feeder drive shaft 34 to drive the feeder drive shaft 34.

The speed and direction of the feeder 32 and the extruder tool 26 are controllable by suitable motor control devices (not shown) as will be apparent to one skilled in the art.

FIG. 2 is a schematic representation of the feeder and extruder tool bearing arrangement. The feeder 32 which can have any appropriate configuration (for example an arrangement of radially extending feeder blades) suitable for feeding the moist powder to be processed, is connected via the tubular feeder drive shaft 34 to the housing of the bearing arrangement 36. The housing of the bearing arrangement 36, and consequently the feeder 32 and feeder drive shaft 34 are rotatably mounted within the further bearing arrangement 40 by means of lower and upper bearings 64 and 66 displaced from one another by a distance in the axial direction sufficient to support the torsional loading imposed on the feeder and extruder tool arrangement. Within the feeder drive shaft 34, the drive shaft 30 of the extruder tool 26 is supported by lower and upper bearings 60 and 62, once again displaced from one another in the axial direction to support the imposed torsional loading.

With the arrangement shown in FIG. 2, the feeder and the extruder tool are able to rotate independently of one another.

The use of the apparatus described above for the production of water-dispersable rod-shaped extrudate granules (e.g., for agricultural use) from moist finely-divided water-insoluble powders will now be described with reference to FIG. 1. In use, the finely-divided water-insoluble powders are introduced at 54 into the chute 16 of the hopper 10. The powder can be moistened before or after introduction into the hopper 10. From there the powders gradually fall under the effect of gravity towards the bottom of the hopper 10. Preferably the powders are not filled above a maximum filling level 56, the maximum filling level 56 being below the level of the bearings. By the rotation of the feeder 32 the powders are fed towards the rotating extruder tool blades 28 of the extruder tool 26. The extruder tool 26 rotates independently of the feeder 32 to force the water insoluble powders (which as a result of the pressure exerted thereon form a paste) through the perforations in the screen 22 to emerge as rod-shaped extrusion granules. The slicing effect of the rotation of the blades 28 means that the rod-shaped granules are formed with a limited length. The extrudate then falls into a container (not shown) located beneath the hopper and over a foot 58 of the apparatus.

Operation of an apparatus in accordance with the invention has demonstrated a number of advantages. Firstly, no motor is provided beneath the hopper with the result that it is easier to collect the extrudate material from beneath the hopper as it is produced. In addition, the invention has surprisingly improved the performance of the extrudates when subsequently dispersed in water. It is believed that this is a result of the reduction in temperature which is possible in an apparatus in accordance with the invention compared to the prior art apparatus. It is possible to reduce the temperature reached during the extrusion of finely-divided water-insoluble powders by a range of 10–20° C. compared to the prior art apparatus. By the elimination of the bearings from a region where damage may be caused as a result of the invasive paste formed during the extrusion process, bearing damage and the undesirable production of additional heat is avoided. With an apparatus in accordance with the invention, as opposed to an apparatus of the prior art type, a 40% increase in the achievable production rate is possible. Moreover, the apparatus can be run continuously without stoppages for maintenance to deal with the effects of seal and bearing wear.

Although a particular embodiment of the invention has been described herein, it will be appreciated that many modifications and/or additions are possible within the scope of the invention.

For example, although the invention has been described in the context of and finds particular application to the production of water-dispersable rod-shaped granules from a moist finely-divided water-insoluble powder, it will be appreciated that the invention may find application to the production of other extrudates from other extrudable materials.

I claim:

1. Apparatus for producing an extrudate from an extrudable material, the apparatus comprising a hopper for the extrudable material having at least one extrusion aperture at or near its lower end; a rotatable extruder tool at or near the lower end of a first drive shaft for forcing the extrudable material though the aperture(s) and a rotatable feeder at or near a lower end of a second drive shaft for feeding the extrudable material to the extruder tool; and bearings located above the extruder tool for rotatably mounting the first drive shaft and the second drive shaft;

wherein said bearings comprise first and second bearings mounting the first drive shaft and axially spaced from one another and third and fourth bearings mounting the second drive shaft and axially spaced from one another; and wherein one of the first and second drive shafts is disposed substantially coaxially around the other of the first and second drive shafts.

2. Apparatus according to claim 1, wherein all said bearings are located above a maximum filling level for the extrudable material within the hopper.

3. Apparatus according to claim 1, wherein the first drive shaft is rotatably mounted within the second drive shaft by means of the first and second bearings.

4. Apparatus according to claim 1, wherein the second drive shaft is rotatably mounted within a fixed bearing housing of the apparatus by means of the third and fourth bearings.

5. Apparatus according to claim 1, comprising a first drive train for driving said first drive shaft from overhead and a second drive train for driving said second drive shaft from overhead.

6. Apparatus according to claim 5, wherein the first drive train includes a first gearing mechanism and the second drive train includes a second bearing mechanism.

7. Apparatus according to claim 5, comprising a first independently controllable motor for the first drive train and a second independently controllable motor for the second drive train.

8. Apparatus according to claim 1, wherein said at least one aperture comprises an annularly extending opening and a perforated screen secured or securable over said opening.

9. Apparatus according to claim 1, wherein the extruder tool comprises a substantially disc-shaped portion and, disposed around the periphery of the disc, a plurality of axially extending extruder tool blades.

10. A method for producing an extrudate from an extrudable material, the method comprising the steps of:

introducing into the hopper of an apparatus according to claim 1, the extrudable material; and forcing the extrudable material through said at least one aperture to form the extrudate.

11. A method according to claim 10, wherein the extrudable material is a finely-divided water-insoluble powder and the extrudate is in the form of water-dispersable granules.

12. A method according to claim 11, wherein the granules are rod-shaped.

13. A method according to claim 11, comprising a step of moistening the powder before introduction into the hopper.

14. A method according to claim 11, comprising a step of moistening the powder in the hopper.

15. Apparatus according to claim 1, wherein the aperture (s) are positioned to extrude the extrudable material in the radial direction relative to the first drive shaft.

* * * * *